US006581681B1

(12) United States Patent
Zimmerman et al.

(10) Patent No.: US 6,581,681 B1
(45) Date of Patent: Jun. 24, 2003

(54) BRIDGE PLUG FOR USE IN A WELLBORE

(75) Inventors: Patrick J. Zimmerman, Houston, TX (US); Danny W. Wagoner, Cypress, TX (US); Tyson Stafford, Cypress, TX (US); David Speller, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/598,049

(22) Filed: Jun. 21, 2000

(51) Int. Cl.[7] ..... E21B 33/12
(52) U.S. Cl. ..... 166/135; 166/138; 166/192
(58) Field of Search ..... 166/118, 123, 166/135, 138, 182, 188, 192, 373, 381, 382, 386, 387

(56) References Cited

U.S. PATENT DOCUMENTS

| | | | | | |
|---|---|---|---|---|---|
| 2,751,017 | A | | 6/1956 | Baker et al. | 166/216 |
| 3,054,450 | A | | 9/1962 | Baker | 166/120 |
| 3,298,440 | A | | 1/1967 | Current | 166/123 |
| 3,507,327 | A | | 4/1970 | Chenoweth | 166/134 |
| 3,623,551 | A | | 11/1971 | Randermann, Jr. | 166/134 |
| 3,678,998 | A | * | 7/1972 | Cockrell et al. | 166/123 |
| 4,146,093 | A | | 3/1979 | Horvath et al. | 166/120 |
| 4,153,109 | A | | 5/1979 | Szescila | 166/250 |
| 4,289,200 | A | * | 9/1981 | Fisher | 166/120 |
| 4,345,649 | A | | 8/1982 | Baugh et al. | 166/120 |
| 4,573,537 | A | | 3/1986 | Hirasuna et al. | 166/387 |
| 4,708,202 | A | | 11/1987 | Sukup et al. | 166/123 |
| 4,784,226 | A | | 11/1988 | Wyatt | 166/376 |
| 4,898,239 | A | | 2/1990 | Rosenthal | 166/133 |
| 5,044,441 | A | * | 9/1991 | Rubbo et al. | 166/382 |
| 5,332,038 | A | * | 7/1994 | Tapp et al. | 166/278 |
| 5,636,689 | A | * | 6/1997 | Rubbo et al. | 166/123 |
| 5,678,635 | A | | 10/1997 | Dunlap et al. | 166/387 |
| 5,775,429 | A | | 7/1998 | Arizmendi et al. | 166/387 |
| 5,810,082 | A | * | 9/1998 | Jordan | 166/120 |
| 5,819,846 | A | | 10/1998 | Bolt, Jr. | 166/123 |

FOREIGN PATENT DOCUMENTS

GB 1 398 038 5/1973

OTHER PUBLICATIONS

PCT International Search Report from PCT/GB 01/02668, Dated Oct. 29, 2001.

* cited by examiner

*Primary Examiner*—Thomas B. Will
*Assistant Examiner*—Jennifer Dougherty
(74) *Attorney, Agent, or Firm*—Moser, Patterson & Sheridan, L.L.P.

(57) ABSTRACT

A bridge plug for use in a wellbore to isolate an upper portion of the wellbore from a lower portion. The bridge plug is run into the wellbore on wireline or run-in tubular and then set in the wellbore at a predetermined depth. In one aspect of the invention, the bridge plug includes a cylindrical body having a longitudinal bore therethrough which is sealed to the passage of fluid. A first and second lock ring assemblies are installed on the outer surface of the body and are designed to move in a single direction with respect to the body. A bidirectional slip member which provides resistance to axial forces in two directions and a sealing member is located on the exterior of the body. A sealing member is disposed between the first and second lock ring assemblies and is actuated by movement of the first ring towards the second ring.

14 Claims, 6 Drawing Sheets

300

BRIDGE PLUG FOR USE IN A WELLBORE

BACKGROUND OF THE INVENTION

1. Field of the Invention

The present invention relates to a downhole tool. More particularly, the invention relates to a bridge plug for sealing the interior of a wellbore at a predetermined location.

2. Background of the Related Art

An oil or gas well includes a wellbore extending from the surface of the well to some depth therebelow. Typically, the wellbore is lined with tubular or casing to strengthen the sides of the borehole and isolate the interior of the casing from the earthen walls therearound. In order to access production fluid in a formation adjacent the wellbore, the casing is perforated, allowing the production fluid to enter the wellbore and be retrieved at the surface of the well. A single well may have multiple levels of production zones. In order to isolate oil from a specific zone, a tool, known as a bridge plug is placed within the wellbore to isolate the upper and lower portions of the zones. Bridge plugs also create a pressure seal in the wellbore allowing fluid pressure to be applied to the wellbore to treat the isolated formation with pressurized fluids or solids.

FIG. 1 is a section view of a well 10 with a wellbore 12 having a bridge plug 15 disposed within the wellbore casing 20. The bridge plug 15 is typically attached to a setting tool and run into the hole on wire line or tubing (not shown), and then actuated with some type of pyrotechnic or hydraulic system. As illustrated in FIG. 1, the wellbore is sealed above and below the bridge plug so that oil migrating into the wellbore through perforations 23 will be directed to the surface of the well.

FIG. 2 is a cross sectional view of a prior art bridge plug 50. The bridge plug 50 generally includes a body portion 80, a sealing member 52 to seal an annular area between the bridge plug 50 and the inside wall of casing (not shown) therearound and slips 56,61. The sealing member 52 is disposed between an upper retaining portion 55 and a lower retaining portion 60. In operation, axial forces are applied to slip 56 while the body and slip 61 are held in a fixed position. As the slip 56 moves down in relation to the body 80 and slip 61, the sealing member is actuated and the slips 56,61 are driven up cones 55,60. In the prior art bridge plug of FIG. 2, the slips are "uni-directional" and are most effective against axial forces applied to the bridge plug in a single direction. The movement of the cones and slips also axially compress and radially expand the sealing member 52 thereby forcing the sealing portion radially outwardly from the plug to contact the inner surface of the well bore casing. The compressed sealing member 52 provides a fluid seal to prevent the movement of fluids across the bridge plug.

There are problems associated with prior art bridge plugs like the one shown in FIG. 2. Bridge plugs are intended to be temporary and must be removed in order to access the wellbore therebelow. Rather than de-actuate the bridge plugs and bring them to the surface of the well, they are more typically destroyed with a rotating milling or drilling device run into the well at the end of a tubular string. As the mill contacts the bridge plug, the plug, usually constructed of cast iron, aluminum or composite material, is "drilled up" or reduced to small pieces which are easily washed out of the wellbore or simply left at the bottom of the wellbore. The more parts making up a bridge plug, the longer the milling operation takes. Likewise, the longer the bridge plug, the longer the drilling operation will take.

Another problem of prior art bridge plugs is related to the location of the slips in the body of the plug. Since the bridge plug is held into place by the slips, the bridge plug breaks free of the wellbore and falls when the milling device reaches and loosens the slips. Depending upon where the slips are located in relation to the top of the bridge plug, a large portion of the plug can remain in one piece when the plug falls. Large pieces of bridge plug in a wellbore can cause delays if other plugs or tools are installed in the wellbore therebelow.

There is a need therefore, for a bridge plug which can effectively seal a wellbore and remain effective when subjected to pressures from above or below when in use. There is a further need for a bridge plug which can be more completely drilled up, resulting in a smaller portion of the plug falling down the wellbore. There is yet a further need for a bridge plug having fewer parts and a reduced length which allows faster dill up times to remove the set plug from the wellbore.

SUMMARY OF THE INVENTION

The present invention relates to a bridge plug for use in a wellbore to isolate an upper portion of the wellbore from a lower portion. The bridge plug is run into the wellbore on wireline or run-in tubular and then set in the wellbore at a predetermined depth. In one aspect of the invention, the bridge plug includes a cylindrical body having a longitudinal bore therethrough which is sealed in at least one direction to the passage of fluid. A first and second lock ring assemblies are installed on the outer surface of the body and are designed to move in a single direction with respect to the body. A bidirectional slip member which provides resistance to axial forces in two directions and a sealing member are also located on the exterior of the body.

The sealing member is disposed between the first and second lock ring assemblies and is actuated by movement of the first lock ring towards the second lock ring. The slip is a circular member with teeth on the outer surface thereof and is arranged to break into segments when radial pressure is applied thereto. The slip is actuated by force applied thereto from a sloped shoulder formed on the body and a sloped surface formed on the second lock ring assembly. In operation, both lock ring assemblies move toward the shoulder as the plug is set in the wellbore, thereby setting the sealing member therebetween and setting the slip between the second lock ring assembly and the shoulder.

In another aspect of the invention, a bridge plug includes a first and second lock ring assemblies movable in opposing directions along the surface of the body. A first lock ring assembly provides force to actuate a sealing member and a bidirectional slip member. The second lock ring assembly provides a means to further actuate the slip and sealing member in the event pressure is applied to the bridge plug from above while it is installed in a wellbore. The bridge plug can be removed from the wellbore by milling without a substantial portion of the unmilled bridge plug falling to the bottom of the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
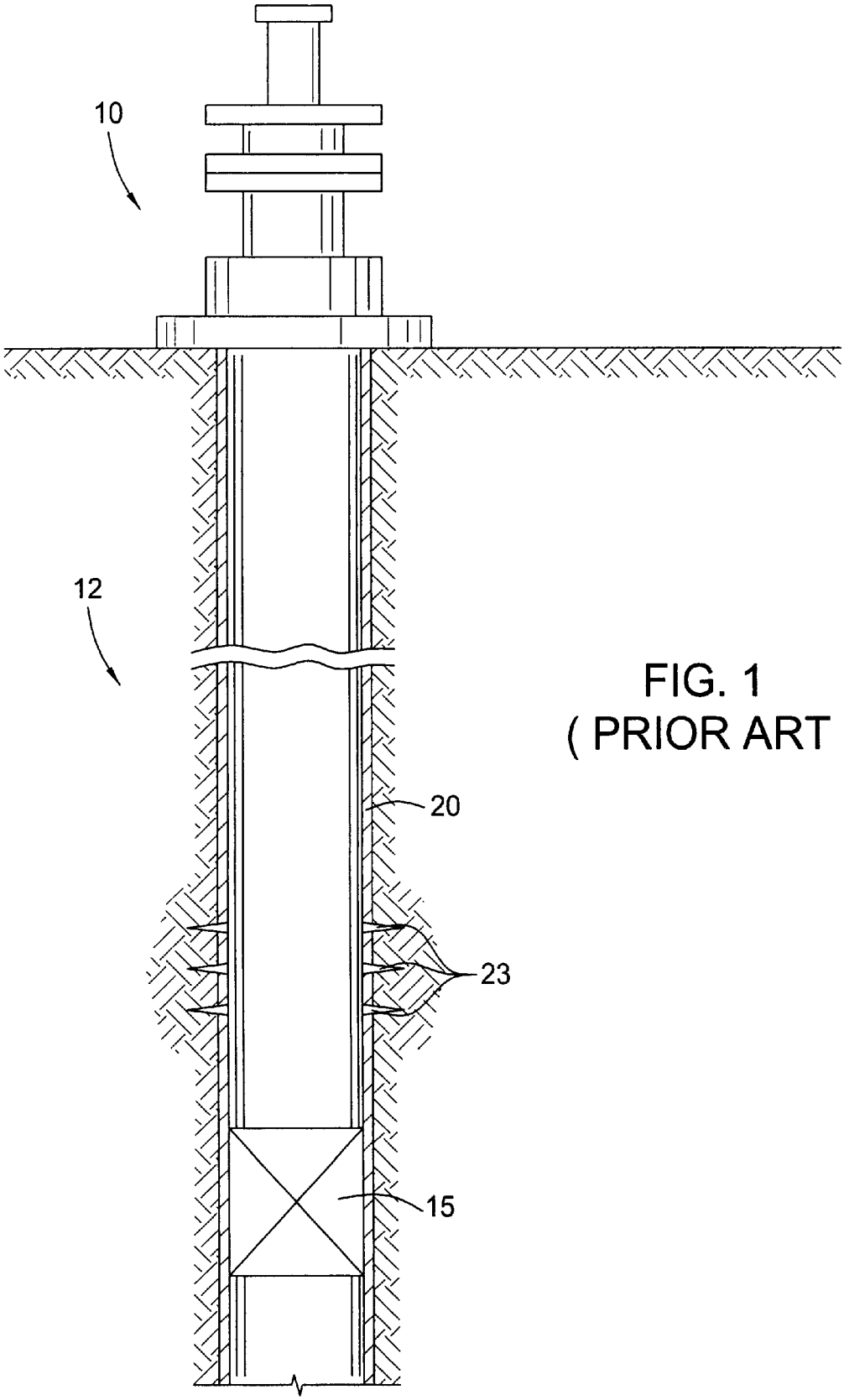
FIG. 1 ( PRIOR ART )
FIG. 1 is a section view of a wellbore with a bridge plug disposed therein.
Figure 2:
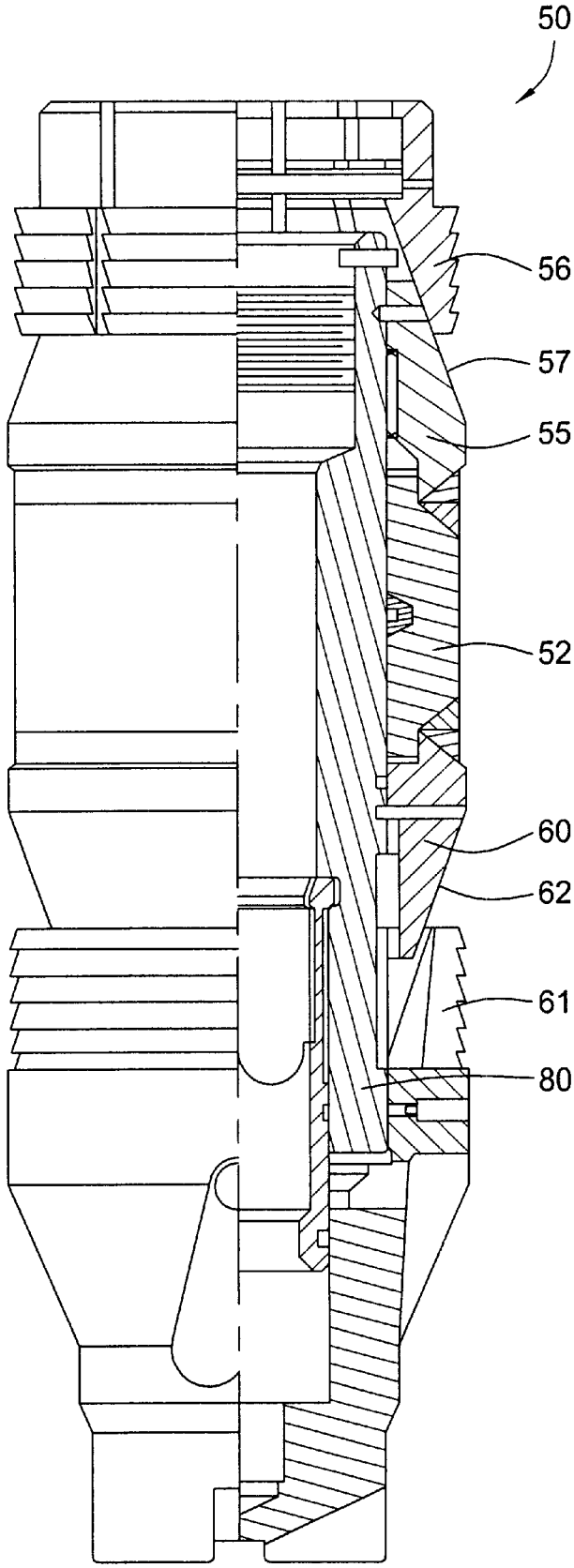
FIG. 2 ( PRIOR ART )
FIG. 2 is a prior art bridge plug.
Figure 3:
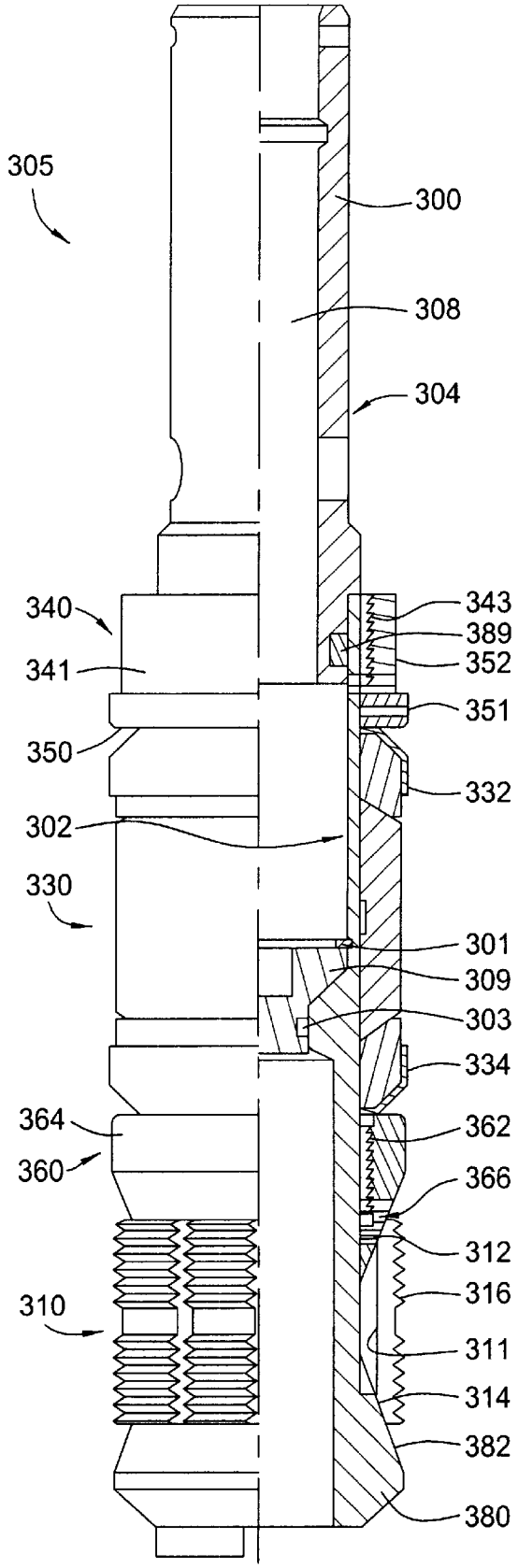
FIG. 3 is one embodiment of a bridge plug of the present invention.

FIG. 3 is a section view showing one embodiment of a bridge plug 305 of the present invention. The bridge plug includes a body 300, a slip 310, a sealing member 330, and a first and second lock ring assemblies 340, 360. The body 300 is a tubular member having a sealed longitudinal bore 308 therethough. An inner surface 302 of the body 300 confines the longitudinal bore 308 within the body and includes a ball (not shown) or a plug 309 disposed thereon. The plug 309 is secured to the inner surface of the body 300 by a retaining ring or snap ring 301. The plug 309 includes at least one o-ring 303 disposed about an outer surface of the plug 309 to provide a good fluid seal between the plug 309 and the inner surface of the body 300. Alternatively, a ball (not shown) may rest within the bore 308 of the body 300 to act as a check valve by allowing flow through the bore 308 in only a single axial direction. The inner surface 302 of the body 300 also includes a shear ring 389 disposed thereon which may attach to a setting tool (not shown) during activation of the plug. An outer surface 304 of the body 300 includes concentric grooves or profiles disposed thereabout to engage mating concentric grooves or profiles disposed on the lock ring assemblies 340, 360 as will be described herein.

The first lock ring assembly 340 is disposed about a first end of the body 300 and includes a ring housing 341 and a split ring 343 disposed therein. The outer surface 351 of the ring housing 341 includes an annular groove 352 disposed therein to provide a collar or shoulder for the setting tool to be disposed thereon. The split ring 343 is a cylindrical member annularly disposed between the body 300 and the ring housing 341, and includes an inner surface having profiles disposed thereon to mate with profiles formed on the outer surface 304 of the body 300.

Figure 3A:
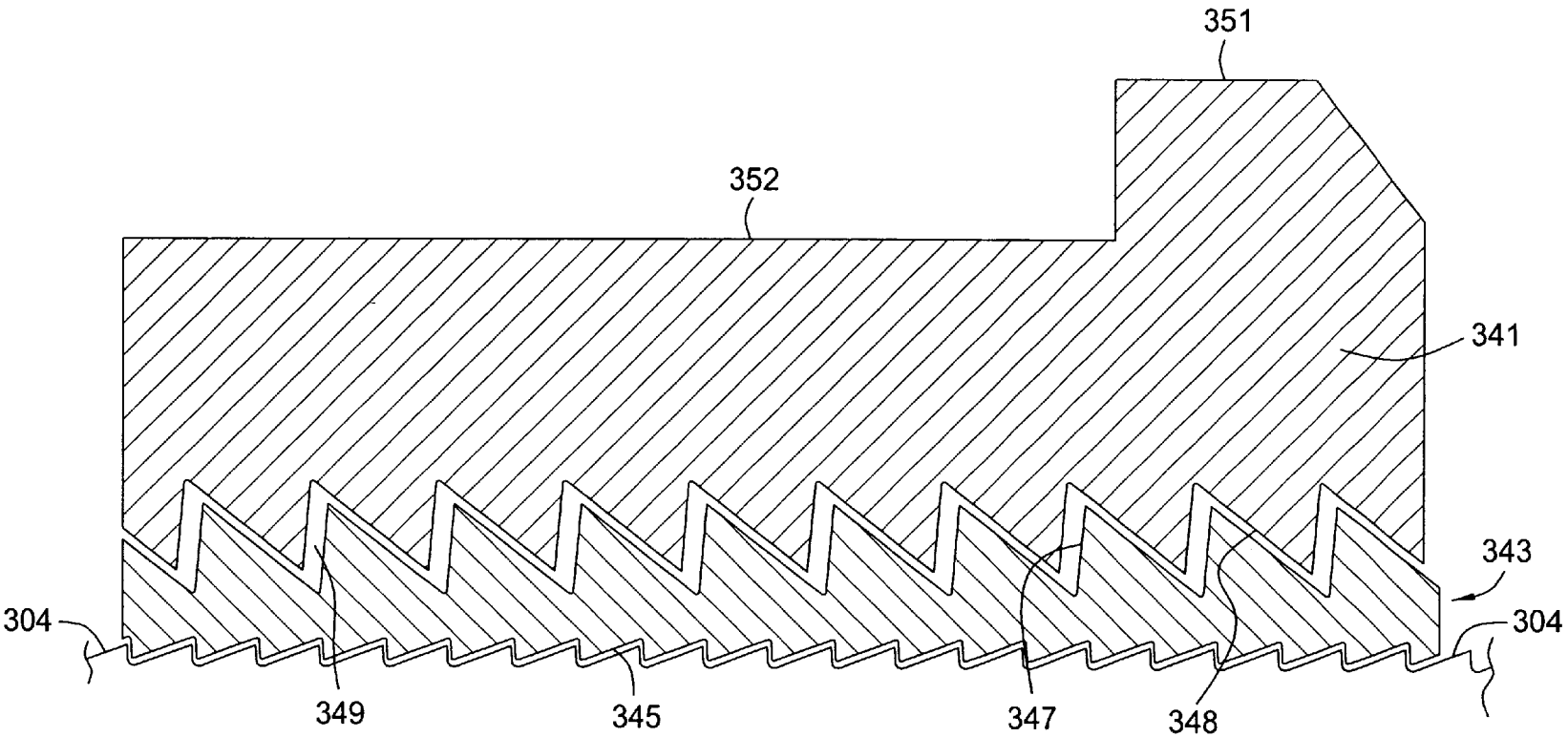
FIG. 3A is an enlarged cross section view of the first lock ring assembly.

FIG. 3A is an enlarged cross section view of the first lock ring assembly 340 and illustrates the interaction between the first lock ring assembly 340 and the body 300. FIG. 3A shows the mating profiles formed on the inner surface 345 of the lock ring 343 and the outer surface 304 of the body 300. In the embodiment illustrated, the profiles formed on the split ring 343 have a tapered leading edge allowing the split ring 343 to move across the mating profiles formed on the body 300 in one axial direction while preventing movement in the other direction. The profiles formed on both the outer surface 304 of the body 300 and the inner surface 345 of the lock ring 343 consist of formations having one side which is sloped and one side which is perpendicular to the surface 304 of the body 300. The sloped surfaces of the mating profiles allows the lock ring 343 to move across the body 300 in a single axial direction. The perpendicular sides of the mating profiles prevent movement in the opposite axial direction. Therefore, the lock ring may move or "ratchet" in one axial direction, but not the other. FIG. 3A also shows the jagged teeth formed on the outer surface 347 of the lock ring 343 and the inner surface 348 of the lock ring housing 341. The relationship between the jagged teeth creates a gap 349 therebetween allowing the lock ring 343 to expand radially as the profiles formed thereon move across the mating profiles formed on the body 300. In addition, the split ring 343 includes a longitudinal cut therein allowing the split ring 343 to expand and contract as it movably slides or ratchets in relation to the outer surface 304 of the body 300. FIG. 3A is also typical of the second lock ring assembly 360 described herein below.

Referring back to FIG. 3, a surface 350 of the ring housing 341 abuts an upper surface of the sealing member 330. The sealing member 330 may have any number of configurations to effectively seal the annulus created between the body 300 and the casing well. For example, the sealing member 330 may include grooves, ridges, indentations or protrusions designed to allow the sealing member 330 to conform to variations in the shape of the interior of wellbore casing (not shown). The sealing member 330 can be constructed of any expandable or otherwise malleable material which creates a permanent set position and stabilizes the body 300 relative to the wellbore casing and which a setting force between the body 300 and the wellbore casing does not cause the sealing member 330 to relax or shrink over time due to tool movement or thermal fluctuations within the wellbore. For example, the sealing member 330 may be a metal, a plastic, an elastomer, or a combination thereof.

In the embodiment shown in FIG. 3, the sealing member 330 is backed by a back-up ring 332 disposed between a upper surface of the sealing member 330 and lower surface 350 of the first lock ring assembly 340. The sealing member 330 is also equipped with a back-up ring 334 disposed between the sealing member 330 and an upper surface of the second lock ring assembly 360. Both the upper and lower back-up rings 332, 334 serve to evenly distribute axial forces asserted on the sealing member 330.

A lower section of the body 300 includes a second lock ring assembly 360 and a slip 310, both disposed about the outer surface of the body 300. The slip is retained between a sloped portion of the ring housing 364 and an outwardly extending shoulder 380 disposed about the outer surface 304 of the body 300. The outwardly extending shoulder 380 has an upper surface which is tapered to form a conical wedge 382. The second lock ring assembly 360 like the first assembly 340 described herein is a cylindrical member concentric with and disposed about the outer surface 304 of the lower section of the body 300. Lock ring assembly 360 includes a ring housing 364 disposed about the outer surface 304 of body 300 and a split ring 362 housed in an annular area between the body 300 and the ring housing 364. The split ring 362 includes concentric profiles disposed thereabout which interact with concentric profiles formed on the outer surface 304 of the body 300 thereby allowing movement of the lock ring assembly 360 along the body 300 in a first direction, as illustrated in FIG. 3A with respect to first lock ring assembly 340. An upper surface of the ring housing 364 abuts the lower surface of back-up ring 334 which contacts sealing member 330. The lower surface of the ring housing 364 is tapered to form a conical wedge 366. An inner and outer surface of the ring housing 364 are similar to the inner and outer surface of the first ring housing 341 described above.

The slip 310 is a ring-shaped member concentric with the body 300. The slip 310 is disposed about the lower portion of the body 300 below the second lock ring assembly 360 and above the sloped portion of shoulder 380 of the body 300. An inner surface 311 of the slip 310 may include a tapered first edge 312 and a tapered second edge 314 to conform to the outer conical surfaces 366, 382 of the second ring housing 364 and the outward extending shoulder 380 of the body 300, respectively.

An outer surface of the slip 310 preferably includes at least one outwardly extending serration or edged tooth 316 to engage an inner surface of the casing (not shown) when the slip 310 is driven radially outward from the body by the movement of sloped surfaces thereunder. The slip 310 is designed to fracture with radial stress and typically includes at least one recessed groove (not shown) milled therein to fracture under stress and allow contact of the slip 310 against the well casing. In one example, the slip 310 includes four evenly spaced segments separated by the recessed grooves that fracture into equal segments all of which contact the well casing and become evenly distributed about the outer surface 304 of the body 300. In the preferred embodiment, the slip is a "bi-directional" slip as it is actuated between cone shaped surfaces 366, 382 on either end thereof. In this manner, the slip resists axial force in either direction and the bridge plug of the present invention is effectively set in a wellbore with a single slip member.

The tool of the invention is designed to be installed in a wellbore with some non-rigid system, like wireline. A setting tool, such as a Baker E-4 Wireline Setting Assembly commercially available from Baker Hughes, Inc., for example, which is attached.at the surface of the well connects to the upper portion of the body 300. Specifically, an outer movable portion of the setting tool is disposed on the annular groove 352 of the first ring housing 341. An inner portion of the setting tool is fastened to the shear ring 309 disposed on the inner surface 302 of the body 300. The setting tool and bridge plug are then run into the well casing to the desired depth where the plug is to be installed.

To set or activate the plug, the body 300 with shoulder 380 is held by the wireline as an axial force is applied through the outer movable portion of the setting tool to the first ring housing 341, thereby causing the body 300 to move axially relative to the outer portions of the bridge plug. The force asserted against the first ring housing 341 causes the first lock ring assembly 340 to move or ratchet down the outer surface 304 of the body 300. As described herein, the ratcheting is accomplished when downward axial force against the first split ring 343 causes the profiles formed on the ring 343 to ramp up and over the mating profiles formed on the outer surface 304 of the body 300. Once the profiles of the ring 343 travel up and over the adjoining profiles of the body 300, the first split ring 343 contracts or snaps back into place, re-setting or interlocking the concentric profiles of the first split ring 343 against the next adjoining profiles formed on the outer surface 304 of the body 300. In this manner, the lock ring assembly 340 moves in a first direction towards sealing member 330.

The downward movement of the first lock ring assembly 340 transmits force to the sealing member 330 causing the malleable material of the sealing member 330 to compress and move in an outward radial direction relative to the body 300. The downward directed force is then transmitted from the sealing member 330 to the second lock ring assembly 360 which ratchets down the outer surface 304 of the body 300 in the same fashion explained above for the first split ring 343. The downward movement of the second lock ring assembly 360 forces the tapered lower surface 366 of the ring housing 364 under slip 310, pushing the slip 310 outwards between the tapered surface 366 of the ring housing 364 and the tapered surface 382 of the stationary shoulder 380.

The outward force applied to the slip causes the recessed grooves of the slip 310 to fracture, and divides the slip 310 into equal segments, permitting the serrations or teeth 316 of the slip 310 to engage the inner surface of the well casing. Once the slip 310 has been set, the compressive forces on the sealing member 330 and the slip segments is maintained by the two lock rings assemblies 340, 360 with their "one way" ratchet mechanisms. The setting tool is then released from the body 300 and the activated bridge plug is left in the wellbore.

Figure 4:
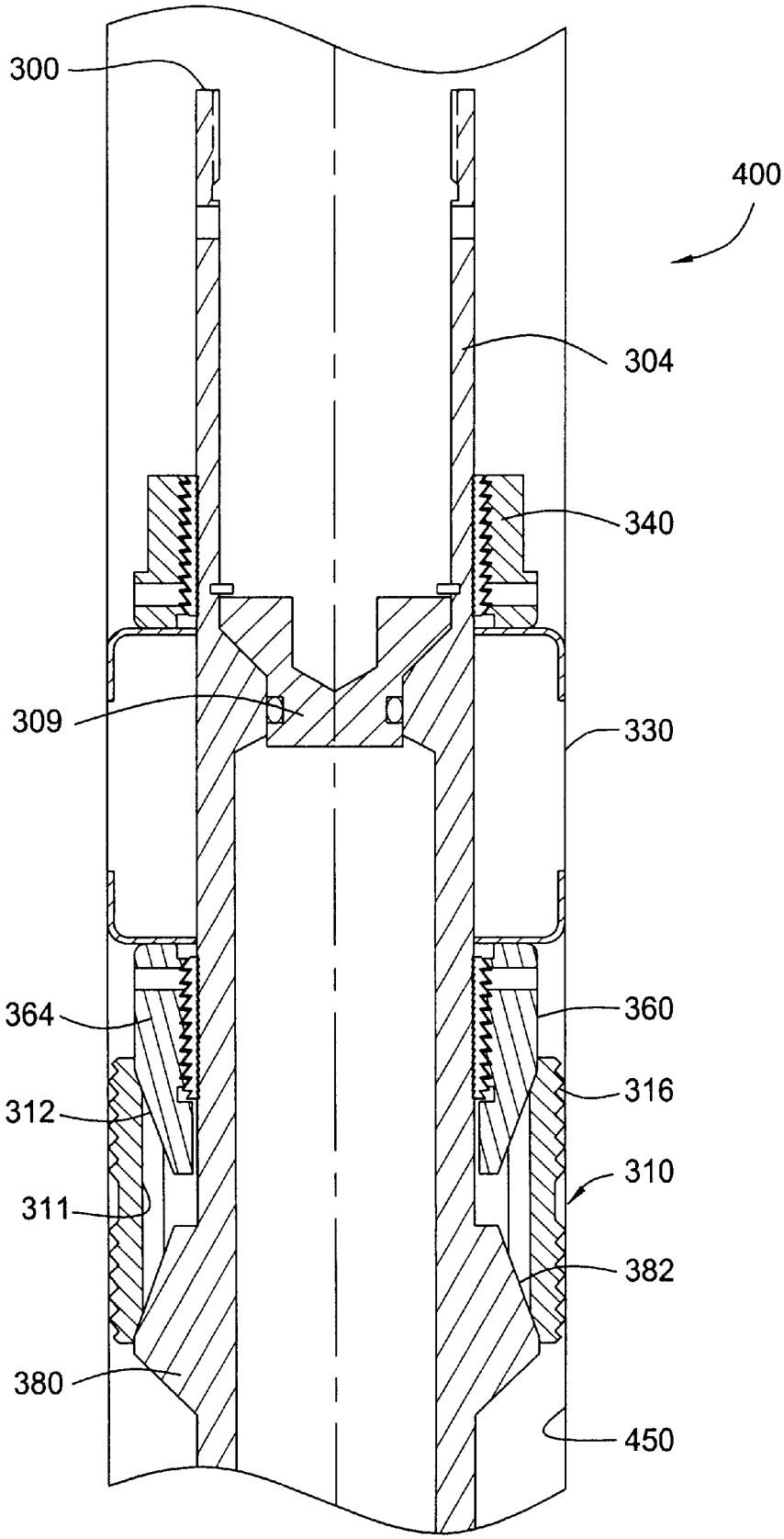
FIG. 4 is a section view of the bridge plug set in a wellbore.

FIG. 4 is a section view of the bridge plug 400 of FIG. 3 after activation. As shown, the lock ring assemblies 340, 360 have ratcheted across the concentric profiles formed on the outer surface. 304 of the body 300. The sealing member 330 has compressed and expanded radially outward to engage the inner wall 450 of the well casing. The second lock ring assembly 360 has driven the tapered surface 366 of the second ring housing 364 underneath the contact surface 311 of the slip 310 thereby forcing the slip 310 up the tapered surface 382 of the outward extending shoulder 380 and radially outward of the body 300. The slip 310 has been forced radially outward of the body 300 to place the serrations 316 of the slip into contact with the inner wall 450 of the well casing.

Figure 5:
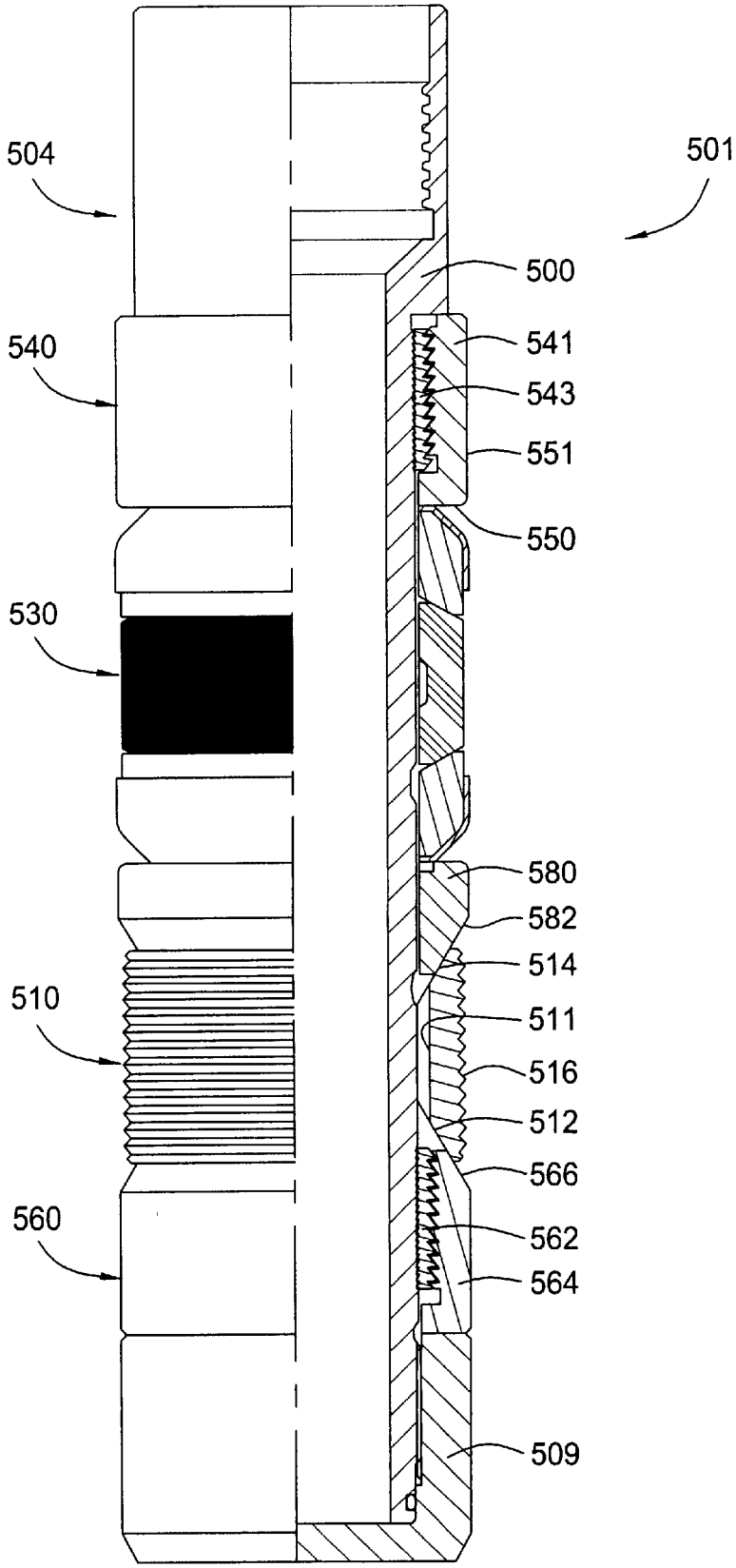
FIG. 5 is a section view of a second embodiment of the bridge plug.

FIG. 5 is a section view of another embodiment of a bridge plug 501 of the invention. Bridge plug 501 includes a body 500, a slip 510, a sealing member 530, and a first and second lock ring assemblies 540, 560. The first lock ring assembly 540 and sealing member 530 are similar to those described above for the bridge plug in FIG. 3. The body 500 is a tubular member having a sealed longitudinal bore 508 therethrough. The bridge plug further includes an intermediate ring 580 disposed about the body. The intermediate ring 580 is an annular member concentric with and disposed about the body 500 between the sealing member 530 and the slip 510. The intermediate ring 580 includes a tapered or conical outer surface 582 for engagement with an inner surface 511 of the slip 510.

The slip 510 is concentric with the body 500 and includes an inner surface 511 having tapered edges 512, 514. The tapered edges 512, 514 conform to the conical outer surface 582 of the intermediate ring 580 and a conical outer surface 566 of the second lock ring assembly 560. In one embodiment, the tapered ends 512, 514 of the slip 510 further include serrations or teeth 516 disposed thereto to engage the conical outer surfaces 566, 582 to prevent the slip 510 from sliding down the conical support surfaces 566,582. The slip 510 also includes at least one outwardly extending serration or edged tooth 516 to engage an inner surface of the casing (not shown) when the slip 510 is driven radially outward from the body 500. In the preferred embodiment, the slip 510 is a "bi-directional" slip as it is actuated between cone shaped surfaces 566, 582 on either end thereof. In addition, the slip 510 typically includes at least one recessed groove (not shown) milled therein which fractures under stress to engage the slip 510 against the well casing. In one aspect, the slip 510 includes four recessed grooves milled therein which fracture the slip 510 into four independent segments distributed about the outer surface 504 of the body 500. The second lock ring 562 is similar to the lock rings 343,362 discussed above. However, the second lock ring 562 moves or ratchets along the body 500 only in the direction of the first lock ring 543.

In operation of the embodiment shown in FIG. 5, a setting tool, such as a Baker E-4 Wireline Setting Assembly commercially available from Baker Hughes, Inc., for example, is attached to the upper portion of the body 500. An outer movable portion of the setting tool is disposed on an upper surface of the first ring housing 541. An inner portion of the setting tool is fastened to a shear ring disposed on an inner surface of the body 500. The setting tool and bridge plug are then run into the hole to the desired elevation where the plug is to be set.

To set or activate the plug, the body 500 is held by the inner portion of the setting tool as a downward axial force is applied through the outer movable portion of the setting tool to the first ring housing 541. The downward directed force causes the first ring assembly 541 to move or ratchet down the outer surface 504 of the mandrel body 500. The ratcheting is accomplished when the downward axial force asserted against the first lock ring 543 causes the lock ring 543 to expand, allowing the profiles formed on the inner surface of the lock ring 543 to ramp up and over the profiles formed on the outer surface 504 of the mandrel body 500. Once the profiles of the first lock ring 543 travel up and over the adjoining profiles of the body 500, the first lock ring 543 contracts or snaps back into place, re-setting or interlocking the concentric profiles of the first lock ring 543 against the next adjoining profiles disposed about the body 500.

The downward movement of the first lock ring 543 assembly transmits the downward directed force to the sealing member 530 and the cone 580. The downward directed force asserted against the sealing member 530 causes the malleable material of the sealing member 530 to compress and move in an outward radial direction relative to the body 500. The downward directed force moves the cone 580 underneath the slip 510, forcing the slip 510 radially outward toward the inner wall of the well casing. The recessed grooves of the slip 510 then fracture and divide the slip 510 into equal segments, permitting the bi-directional serrations or teeth 516 on the outer surface of the slip 510 to engage the inner wall of the well casing.

Once the sealing member 530 and slip 510 are engaged, the downward directed force is met by an equal and opposite force exerted by the well casing. Therefore, the continued downward force sets the body 500 in motion relative to the members (the sealing member 530, the cone 580, and the slip 510) freely disposed about the outer surface 504 of the body 500. Resultingly, the body 500 ratchets underneath the second lock ring assembly 560 whereby the slip 510 and the sealing member 530 are held in place, and whereby a gap is formed between the second lock ring assembly 560 and the lower portion of the body 500 having the plug 509 disposed thereabout. When a pre-determined upward force is reached, the shear ring (not shown) severs from the body 500, and the setting tool is released from the body 500. The tapered edges 512,514 of the contact surface 511 of the slip 510 include serrations or teeth (not shown) to engage the conical surfaces 566,582 of the cone 580 and the second lock ring housing 564. The serrations prevent downward movement or movement in the radially inward direction relative to the body 500 once the slip 510 has been set and engaged.

One bridge plug described herein may be activated as described above or alternatively, two or more bridge plugs may be stacked in series. It is also believed that the bridge plugs described herein may be used in either axial direction. Furthermore, the bridge plug may be released and removed from the hole by drilling or milling. The mill time of the bridge plug described herein is dramatically reduced due to the limited number of parts comprising the plug. In addition, the configuration of the plug allows an operator to mill more of the plug before the slip 310 or 510 releases from the well casing causing any un-milled portion of the plug to fall down the hole.

While foregoing is directed to the preferred embodiment of the present invention, other and further embodiments of the invention may be devised without departing from the basic scope thereof, and the scope thereof is determined by the claims that follow.

What is claimed is:

1. A bridge plug for use in a wellbore, comprising:

a body having a bore there-through sealed in at least one direction;

a shoulder on an outer surface of the body;

a first lock ring portion disposed about the body and movable along the body towards the shoulder;

a single, bi-directional slip member disposed about the body between the shoulder and the first lock ring portion, whereby, as the first lock ring portion moves towards the shoulder the slip member is urged outward radially to engage an inner surface of a tubular there-around;

a second lock ring portion disposed about the body and movable along the body towards the shoulder;

a sealing member adjacent to and disposed about the body between the first and second lock ring portions, the sealing member compressible between the lock ring portions to seal an annular area between the body and the inner surface of the tubular there-around; and whereby the bridge plug is removable from the wellbore through drilling without substantially drilling the slip.

2. The bridge plug of claim 1, wherein the shoulder includes a sloped surface, the surface sloped downward in the direction of the slip.

3. The bridge plug of claim 1, wherein each lock ring portion comprises a lock ring housing and a lock ring disposed therein, the lock ring having profiles formed on an inner surface thereof to interact with mating profiles formed on the outer surface of the body, thereby allowing movement of the lock ring assembly towards the shoulder and preventing movement of the lock ring in an opposite direction.

4. The bridge plug of claim 3, wherein the outer surface of the lock ring includes profiles formed thereupon and the inner surface of the lock ring housing includes mating profiles formed thereupon, the profiles forming a gap between the lock ring and the lock ring housing, thereby allowing radial expansion of the lock ring as the lock ring assembly moves towards the shoulder.

5. The bridge plug of claim 1, wherein the second lock ring portion includes a surface formed thereon, the surface sloped downward in the direction of the slip.

6. The bridge plug of claim 1, wherein the slip member is designed to separate into at least two segments upon a radial outward force applied thereto.

7. The bridge plug of claim 1, wherein the first lock ring assembly moves towards the shoulder and the sealing member is compressed longitudinally and expanded radially, thereby sealing the annular area.

8. The bridge plug of claim 1, wherein the second lock ring assembly moves towards the shoulder and the slip member is urged radially outward to fix the bridge plug within the tubular therearound.

9. A bridge plug for installation in and sealing of a wellbore, comprising:

a body with a bore therethrough, the bore sealed in at least one direction;

a first lock ring assembly at a first end of the body, movable along an outer surface of the body towards a second end of the body;

a second lock ring assembly at the second end of the body, movable along the outer surface of the body towards the first end of the body;

a sealing member disposed around the body between the first lock ring member and an intermediate ring, the sealing member actuatable upon movement of the first lock ring assembly towards the second end of the body; and a slip member disposed between the second lock ring assembly and the intermediate ring, the slip actuated upon movement of the intermediate ring towards the second end of the body.

10. The bridge plug of claim 9, wherein the first lock ring assembly includes a lock ring having profiles formed there-upon to interact with mating profiles formed upon the outer surface of the body, the profiles permitting movement of the first lock ring assembly only in the direction of the second end of the body.

11. The bridge plug of claim 9, wherein the second lock ring assembly includes a lock ring having profiles formed thereupon to interact with mating profiles formed upon the outer surface of the body, the profiles permitting movement of the second lock ring assembly only in the direction of the first end of the body.

12. A permanent bridge plug for use in a wellbore, comprising:

a body having a bore there-through sealed in at least one direction;

a shoulder on an outer surface of the body;

a first lock ring portion disposed about the body and movable along the body towards the shoulder;

a bi-directional slip member disposed about the body between the shoulder and the first lock ring portion, whereby, as the first lock ring portion moves towards the shoulder the slip member is urged outward radially to engage an inner surface of a tubular there-around;

a second lock ring portion disposed about the body and movable along the body towards the shoulder; and a sealing member, adjacent to and disposed about the body between the first and second lock ring portions, the sealing member compressible between the lock ring portions to seal an annular area between the body and the inner surface of the tubular there-around.

13. The permanent bridge plug of claim 12, wherein the plug is removable from the wellbore by drilling up the plug.

14. The permanent bridge plug of claim 12, wherein the plug is substantially drilled up prior to disengaging the bi-directional slip from the inner surface of the tubular surrounding there-around.

* * * * *